US010076149B2

(12) United States Patent
Ross et al.

(10) Patent No.: US 10,076,149 B2
(45) Date of Patent: Sep. 18, 2018

(54) ADJUSTABLE FACIAL PROTECTION SYSTEMS

(71) Applicant: Eye Safety Systems, Inc., Foothill Ranch, CA (US)

(72) Inventors: Brian Ross, Ketchum, ID (US); Aaron Taylor, Hailey, ID (US); Chris Randolph Dawson, Murrieta, CA (US); Joshua Robert Gallegos, Corona, CA (US)

(73) Assignee: Eye Safety Systems, Inc., Foothill Ranch, CA (US)

( * ) Notice: Subject to any disclaimer, the term of this patent is extended or adjusted under 35 U.S.C. 154(b) by 424 days.

(21) Appl. No.: 14/307,349

(22) Filed: Jun. 17, 2014

(65) Prior Publication Data

US 2015/0026858 A1 Jan. 29, 2015

Related U.S. Application Data

(63) Continuation of application No. 13/153,250, filed on Jun. 3, 2011, now abandoned.

(Continued)

(51) Int. Cl.

*A41D 13/00* (2006.01)
*A63B 71/10* (2006.01)

(Continued)

(52) U.S. Cl.

CPC ..... *A42B 3/18* (2013.01); *A42B 3/20* (2013.01); *A42B 3/205* (2013.01); *A42B 3/228* (2013.01); *F41H 1/04* (2013.01)

(58) Field of Classification Search

CPC .. A42B 3/12; A42B 3/127; A42B 3/18; A42B 3/20; A42B 3/08; A42B 3/326;

(Continued)

(56) References Cited

U.S. PATENT DOCUMENTS 2,616,081 A 11/1952 Weaver et al.
2,935,985 A 5/1960 Andrews et al.

(Continued)

FOREIGN PATENT DOCUMENTS

DE 10240744 B3 * 4/2004 ..... A42B 3/326
FR 2864753 A1 * 7/2005 ..... A42B 3/10
WO WO 2006093868 A2 * 9/2006 ..... A42B 3/20

OTHER PUBLICATIONS http://ecx.images-amazon.com/images/I/51hHAUvwykL.jpg (retrieved online Jun. 3, 2010).

(Continued)

*Primary Examiner* — Jameson Collier

(74) *Attorney, Agent, or Firm* — Sterne, Kessler, Goldstein & Fox P.L.L.C.

(57) ABSTRACT

Devices, systems, and methods, etc., that provide, in certain aspects, a two-point, adjustable, partially pliable, and releasable tensioning suspension that supports an anti-blunt-force frame connected to a protective helmet. The protective devices herein can be, for example, "sport-level" and "military/law enforcement-level." The anti-blunt-force frame is positioned and balanced on the wearer's face by an impact absorbing face padding system, including a chin strap, cup or pad comprised of an impact protection material. Thus, in one aspect, the present devices, systems, methods, etc., include an adjustable facial protection system for a human comprising a crescent-shaped face protection element configured to withstand blunt force impact and a ballistic material element to prevent the penetration of ballistic and fragmentation projectiles at various force levels to meet different ballistic hazards. The systems can also include a protective helmet.

46 Claims, 8 Drawing Sheets

Related U.S. Application Data

(60) Provisional application No. 61/351,271, filed on Jun. 3, 2010.

(51) Int. Cl.

| | |
|---|---|
| ***A42B 1/00*** | (2006.01) |
| ***A42B 3/00*** | (2006.01) |
| ***A42B 3/30*** | (2006.01) |
| ***A42B 7/00*** | (2006.01) |
| ***F41H 1/04*** | (2006.01) |
| ***A42B 3/18*** | (2006.01) |
| ***A42B 3/20*** | (2006.01) |
| ***A42B 3/22*** | (2006.01) |

(58) Field of Classification Search

CPC ..... A42B 3/328; A42B 3/28; A42B 3/205; A42B 3/228; A63B 71/10; F41H 1/04; F41H 1/08

USPC .. 2/2.5, 6.1, 6.2, 6.6, 9, 410, 420, 422, 424, 2/427, 428, 429

See application file for complete search history.

(56) References Cited

U.S. PATENT DOCUMENTS

| | | | | | |
|---|---|---|---|---|---|
| 3,430,261 | A | | 3/1969 | Benner | |
| 3,873,998 | A | | 4/1975 | Norris et al. | |
| 3,984,875 | A | * | 10/1976 | Farquharson | A42B 3/08 2/10 |
| 4,916,759 | A | | 4/1990 | Arai | |
| 5,005,926 | A | * | 4/1991 | Spielberger | G02B 5/285 359/359 |
| 5,190,802 | A | * | 3/1993 | Pilato | B32B 5/26 156/306.6 |
| 5,263,204 | A | | 11/1993 | Butsch | |
| 5,329,641 | A | | 7/1994 | Kalhous | |
| 5,448,780 | A | * | 9/1995 | Gath | A42B 3/08 2/411 |
| 5,603,117 | A | * | 2/1997 | Hudner, Jr. | A42B 3/127 2/423 |
| 5,752,298 | A | | 5/1998 | Howell | |
| 6,012,164 | A | | 1/2000 | Deal, III | |
| 6,237,161 | B1 | * | 5/2001 | Lee | A42B 3/326 2/414 |
| 6,247,811 | B1 | | 6/2001 | Rhoades et al. | |
| 6,281,149 | B1 | * | 8/2001 | Hussein | B32B 5/24 139/383 R |
| 6,481,024 | B1 | * | 11/2002 | Grant | A42B 3/08 2/421 |
| 6,490,729 | B1 | | 12/2002 | Dondero | |
| 6,786,786 | B1 | * | 9/2004 | Davis | B63C 9/135 441/120 |
| 6,923,537 | B2 | * | 8/2005 | Hartley | A61F 9/022 351/83 |
| 7,308,721 | B1 | * | 12/2007 | Rivera, Jr. | A42B 3/18 2/207 |
| 2003/0070200 | A1 | | 4/2003 | Crye et al. | |
| 2004/0003452 | A1 | | 1/2004 | Schiebl | |
| 2005/0204446 | A1 | * | 9/2005 | Wright | A61F 9/045 2/9 |
| 2006/0288468 | A1 | | 12/2006 | Jorgenson | |
| 2007/0050895 | A1 | * | 3/2007 | Broersma | A61F 9/029 2/426 |
| 2007/0186324 | A1 | * | 8/2007 | Sheldon | A42B 3/20 2/9 |
| 2008/0289085 | A1 | | 11/2008 | Bryant et al. | |
| 2009/0044316 | A1 | * | 2/2009 | Udelhofen | A42B 3/20 2/424 |
| 2011/0061152 | A1 | * | 3/2011 | Wismann | A42B 3/20 2/424 |
| 2014/0033406 | A1 | * | 2/2014 | Lebel | A42B 3/04 2/422 |
| 2014/0143937 | A1 | * | 5/2014 | Cram | A42B 3/32 2/410 |
| 2014/0317835 | A1 | * | 10/2014 | Mejia, Jr. | A42B 3/20 2/424 |
| 2015/0033457 | A1 | * | 2/2015 | Tryner | A42B 3/08 2/421 |
| 2016/0029734 | A1 | * | 2/2016 | Kurpjuweit | A42B 3/205 2/422 |

OTHER PUBLICATIONS http://worthsports.com/fastpitch/protective/face-first (retrieved online Jun. 3, 2010).

* cited by examiner

ADJUSTABLE FACIAL PROTECTION SYSTEMS

PRIORITY CLAIM

The present application is a continuation of U.S. patent application Ser. No. 13/153,250, filed Jun. 3, 2011, which claims the benefit of U.S. Provisional Patent Application No. 61/351,271, filed Jun. 3, 2010, which application is incorporated herein by reference in its entirety.

BACKGROUND

Many variations of blunt force and ballistic impact protectors for the face and jaw have been designed in the past with a common feature of a rigid attachment to a helmet. However, such systems have performance limitations because they diminish the user's field of view, limit mobility in confined spaces, retain heat and moisture, and/or make helmet systems more difficult to don and doff.

Thus, there has gone unmet a need for improved devices, systems and methods that can provide at least one of improved facial or neck protection to first-responder and military personnel likely to be put in harm's way, such as soldiers, law enforcement officers, and firefighters.

The present systems and methods, etc., provide these and/or other advantages.

SUMMARY

The devices, systems, and methods, etc., herein provide, in certain aspects, a two-point, adjustable, partially pliable, and releasable tensioning suspension that supports an anti-blunt-force frame connected to a protective helmet. The protective devices herein can be, for example, "sport-level" and "military/law enforcement-level." As used herein, "sport-level" indicates face protection capable of withstanding the impacts and traumas experienced in sports such as football, hockey and baseball, while "military/law enforcement-level" means law enforcement officers, firefighters, soldiers, sailors, and the like, i.e., personnel who are likely to encounter heavy blunt force impacts such as vehicle crashes, bats, truncheons, thrown rocks and ballistic impacts such as .22 caliber and 9-millimeter and 0.44 magnum bullets as well as fragmentations from anti-personnel devices such as grenades and improvised explosive devices (IEDs). Thus, a military/law enforcement-level protection system herein typically meets or exceeds the 2010 National Institute of Justice (NIJ) Level IIIA helmet standards for the helmets herein, 2010 NIJ IIIA standards for body armor, and the face protection element and ballistic armor meets or exceeds or MIL-DTL-43511D and/or the 2010 NIJ Level I, Level IIA, or Level II body armor standards, as desired.

The anti-blunt-force frame is positioned and balanced on the wearer's face by an impact absorbing face padding system, including a chin strap or cup, which can be padded if desired. One advantage of this design is that it allows the device to be worn closely on a wide variety of face sizes which is advantageous in confined spaces such as inside military vehicles. It also has the benefit of being rapidly removable from the wearer's face in the event that a gas mask must be donned suddenly, or if the wearer's facial area needs medical attention. The close proximity to the face also increases the wearer's field of view and allows for eye protection such as goggles to be easily donned and doffed. Optional embodiments include open frame designs at the mouth area to allow heat and exhaled moisture to dissipate to the outside environment without impedance.

Thus, in one aspect, the present devices, systems, methods, etc., herein include an adjustable facial protection system for a human comprising a crescent-shaped face protection element configured to withstand blunt force impact and a ballistic material element to prevent the penetration of ballistic and fragmentation projectiles at various force levels to meet different ballistic hazards. The systems can also include a protective helmet.

The face protection element comprises a substantially rigid frame having a right side and a left side, which frame can be comprised of multiple adjoined frame elements or a singular frame element or otherwise as desired. The face protection element can further comprise at least one interior impact absorbing contact point, such as a chin cup or cheek pad configured to hold the face protection element in place against a jaw or face of a user. The frame can comprise at least one right side frame attachment point and one side frame attachment point configured to attach the frame to the helmet. Briefly, the attachment points each attach to corresponding elongated connector elements extending from the respective frame attachment point to a corresponding helmet attachment point located on the protective helmet, such that the elongated connector elements depend substantially vertically from the helmet to the face protection element when the face protection element can be connected to the helmet, wherein, for both sides, the elongated connector element can be pliable and resilient so as to securely retain the face protection element on the jaw of a user and in front of the user's face while simultaneously pliably suspending the face protection element from the helmet, and wherein, for both sides, at least one of the elongated connector element, the side attachment point and the helmet attachment point can be structured such that the distance between the face protection element and the helmet can be selectively adjusted such that the helmet can fit a wide variety of different head sizes. In certain embodiments, the adjustment can be from about 1 inch to 2 inches to 3 inches.

In other aspects, the devices, systems, etc., can comprise only certain devices or sub-systems of the complete systems herein, for example the face protection element without the helmet (albeit configured for attachment to the helmet); the extensible elongated connector elements; or, at least the inner layer and rigid frame layer discussed further below configured to attach to the anti-ballistic layer.

In one embodiment, at least one of the elongated connector element, the side attachment point and the helmet attachment point can comprise a quick release mechanism such that at least one side of the face protection element can be quickly released from the helmet in a single motion by a user. Both the right side and the left side of the face protection element can comprise quick release mechanisms to quickly release the entire face protection element from the helmet. The quick release mechanism can be any desired quick release mechanism, such as those described in U.S. Pat. No. 6,490,729 for a different purpose. For example, the quick release mechanism can be a snap, a quick release buckle, a pull-tab, a ratchet, or a pin and hole mechanism. The system can comprise opposed quick release mechanisms (or other configurations, for example where there is a tensioner member that stabilizes the face protection system on the user, such as a neck strap or side/rear helmet straps) and wherein the system further can comprise a single quick release activator operably connected to all attachment points such that activation of the activator simultaneously releases the attachments in a single motion (or all of the quick release mechanisms if there are more than two quick release mechanisms). The activator can be any desired, effective activator, such as a depressible button, pull-tab, or twistable knob.

The helmet attachment points can be located at any suitable location on the helmet. In one embodiment, the helmet attachment points are located at about the temples of a user and on a forward lip of the helmet, i.e., at about the temporal line of the frontal bone of the skull.

Thus, the facial protection systems can be attached to the brim, or two front suspension bolts, or suspension straps, or other suitable attachment points, found on many military-level helmets such as the Combat Vehicle Crewman (CVC) helmet and an Army Combat Helmet (ACH), as well as the Modular Integrated Communications Helmet (MICH), Personnel Armor System for Ground Troops (PASGT), and the Lightweight Helmet (LWH), etc. Moreover, a single facial protection system herein can be adjusted to fit two or more—or all—of these and other different helmet types and sizes, as well as fitting a wide variety of head and facial types and sizes. Thus, the face protection system can be sized and configured to be used with a variety of helmets including at least helmets with or without ear coverage protection.

In certain embodiments, the elongated connector elements extend substantially vertically between the end areas of either side of the face protection element and their respective attachment points on the helmet; the elongated connector elements can be permanently or semi-permanently attached to either the helmet or the face protection element and releasably attached to the other. The elongated connector elements can be comprised of any suitable material (including composites or combination of materials) such as plastics, rubbers, metals, natural fibers, etc., and can comprise, e.g., ratchet strips, friction fits, adjustment holes or detents and at least one of the attachment element of the face protector or the attachment point on the helmet can comprise a ratchet or other adjustment mechanism configured to releasably, selectively ratchet the elongated connector element and hold the connector element in place when a desired size is achieved. The face protection system further can comprise at least one tensioner member such as a horizontal or angled neck strap or side/rear helmet strap(s) configured to extend from one side of the face protection element behind the neck of a user and attach to the other side of the face protection element for added system stability if desired.

The face protection element can comprise a) an inner layer comprising an interior contact point such as a chin strap, cup or pad comprised of an impact protection material and/or cheek pads; b) a substantially rigid frame layer, wherein the frame is strong enough to resist blunt force impacts including for example military-level blunt force impacts; and, c) an optional ballistic armor material layer comprising one or more ballistic armor materials strong enough to resist military-level ballistic projectiles. If desired, the rigid frame layer can also be configured to resist ballistic impacts and projectiles, the ballistic layer can be configured to resist blunt-force impacts, and each can be configured to resist other possible impacts and insults such as attacks by stabbing and/or edged weapons such as knives, bayonets and swords. Thus, in certain aspects, the specifics of the type and form of impacts, attacks, etc., to be protected against can be varied for each of the rigid frame layer and the armor layer.

The layers can be arranged as follows from interior to exterior: the inner impact absorbing suspension padding layer then the substantially rigid frame layer then the optional ballistic armor material layer. The ballistic armor material layer can be soft armor fabric and can be removably attached to at least one of the other two layers, and the inner layer can comprise at least three pads, one for a left cheek of a user, one for the chin cup, and one for a right cheek of a user. The inner layer (and other layers, if desired) can be discontinuous. For example, the pads can be held to each other and to the other layers of the face protection system by at least one strap extending from one side of the face protection system to the other. The pads can be interchangeable sizes to accommodate different face/head sizes, to vary ventilation or protection levels, or for other purposes as desired.

The substantially rigid frame can be fully rigid, and the substantially rigid frame can be ventilated with a plurality of ventilation holes configured to pass substantial amounts of air from the exterior to the user. The ventilation holes can comprise between about 20 percent to 30 percent, at least 50 percent, or at least 80 or 90 or even 95 or more percent of the surface area of the substantially rigid frame. In some embodiments, the rigid frame can be made of any suitable plastic or metal, such as wire. The ventilation holes can, if desired, comprise a filter media or other structure configured to inhibit the passage of unwanted materials to the face, neck, etc., of the user.

In a further aspect, the face protection element can comprise a) an inner layer comprising an interior contact point and b) a substantially rigid frame layer. At least one of the inner layer and the substantially rigid frame layer can comprise at least two ballistic armor material attachment elements configured to releasably retain a ballistic armor material layer as a further layer of the face protection element.

The inner layer can comprise any suitable material such as a crush protection material selected from at least one of an energy dissipating foam, an energy dissipating gel, or an air bladder, as well as hydraulics or suspension systems, etc. The rigid frame layer can be formed of any suitable material such as plastic or metal or metal wire and can be made by injection molding or other manufacturing processes. The ballistic armor material layer can be soft or hard and can be formed of any desired ballistic material, such as Kevlar®, Twaron®, Spectra Shield®, Dyneema®, aramid fibers or ultra high molecular weight polyethylene, thermoplastic elastomers such as polycarbonates such as Lexan®, or other suitable molded polycarbonates, or ceramics.

In some embodiments, upon quick release of one side of the face protection element, the face protection element swings freely and hangs downwardly via the elongated connector element from a forward portion of the helmet.

In still further aspects, the face protection element further can comprise a transparent or optical face shield, or face shield extending upwardly from an upper edge of the face protection element and sized to cover at least a nose and eyes of a user, for example to protect the user from frontal and some angular impacts. The transparent or optical face shield can be releasably attached to the upper edge of the face protection element, including the uppermost edge of the face protection element, or the transparent or optical face shield can be attached to at least a middle portion between an upper edge and a lower edge of the face protection element.

The transparent or optical face shield can be clear or can be tinted gray, yellow, brown or rose or other color(s) as desired. For example, the transparent or optical face shield can be tinted to selectively enhance wavelengths of light most useful for a person firing a ballistic weapon, and the face shield can comprise a UV protective coating. An upper edge of the transparent or optical face shield can be spaced at least about 1 inch, 2 inches, 3 inches, or more from the forward lip of the helmet or abut the front lip of the helmet using a fending standoff element (e.g., a strut that extends from the helmet and holds the transparent or optical face shield a desired distance from the lip of the helmet) when the face protection element can be fully attached to the helmet. This standoff from the front lip of the helmet can provide enhanced ventilation for a user, which can be important not just for comfort but to reduce the likelihood of exhaustion and heat stroke in hot environments. The upper edge can also contact the helmet for improves performance in cold environments. The transparent or optical face shield can also be pivoted on the face protection element so that it can be moved forward and backward relative to the user's face and to the rest of the protection system, for example for purposes of adjustable ventilation, for cleaning, or for permitting access to the user's face or equipment that is behind the transparent or optical face shield, such as the user's goggles or eyes.

The face protection system further can comprise at least one neck or throat protector extending downwardly from the face protection element and sized to cover at least a substantial portion of a neck or throat of a user. The neck or throat protector can be rigidly affixed to the face protection element, and the neck or throat protector can be attached to the face protection system such that the neck protector can move independently of the face protection element. Thus, in certain embodiments, the neck or throat protector can be hinged or dangle from the face protection element and the neck or throat protector can itself be rigid or flexible. In some embodiments, the neck or throat protector is configured to cooperatively work with and interact with throat protection projecting upwardly from body armor worn by a soldier.

In some embodiments, the face protection system can be configured to include or hold one or more of a heads up display, lighting systems, communications systems or a hydration system.

The substantially rigid frame of the face protection system can be configured to be size adjustable to selectively increase or decrease the breadth, radius or width of the substantially rigid frame. For example, the substantially rigid frame can comprise at least two opposing pieces joined in a center region wherein the joint or hinge between the pieces can be expandable to provide the adjustability, or the frame can comprise at least three pieces joined to each other at either side below the cheek of a user. Similarly, the anti-ballistic material of the face protection system can be also adjustable to selectively vary the radius of the anti-ballistic material element.

These and other aspects, features and embodiments are set forth within this application, including the following Detailed Description and attached drawings. In addition, various references are set forth herein; all such references are incorporated herein by reference in their entirety.

DETAILED DESCRIPTION

Figure 1:
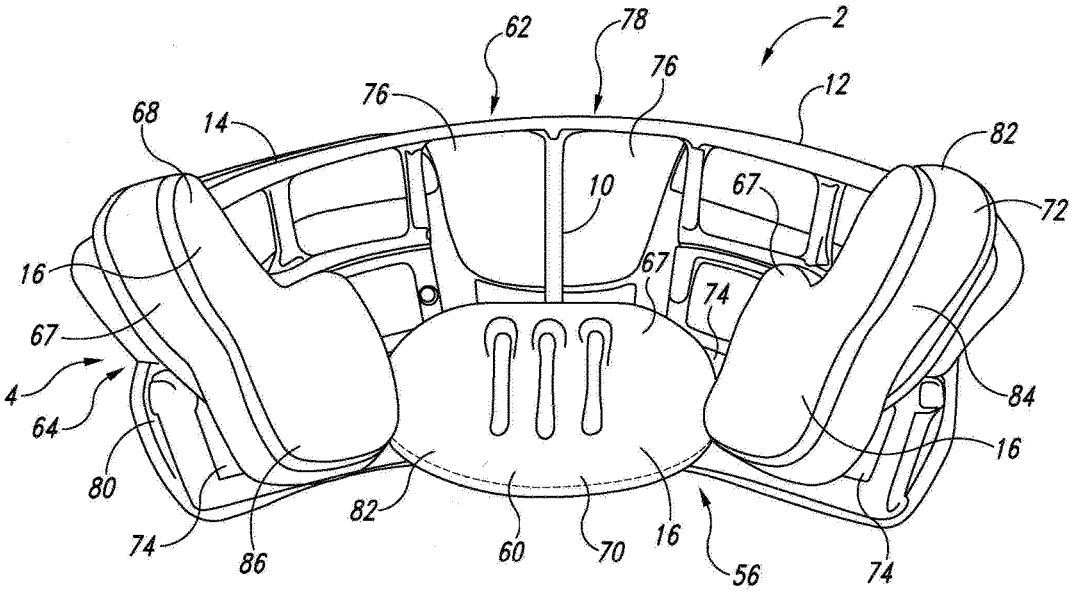
FIG. 1 depicts a rear view of a crescent-shaped face protection element of an adjustable facial protection system as discussed herein.
Figure 2:
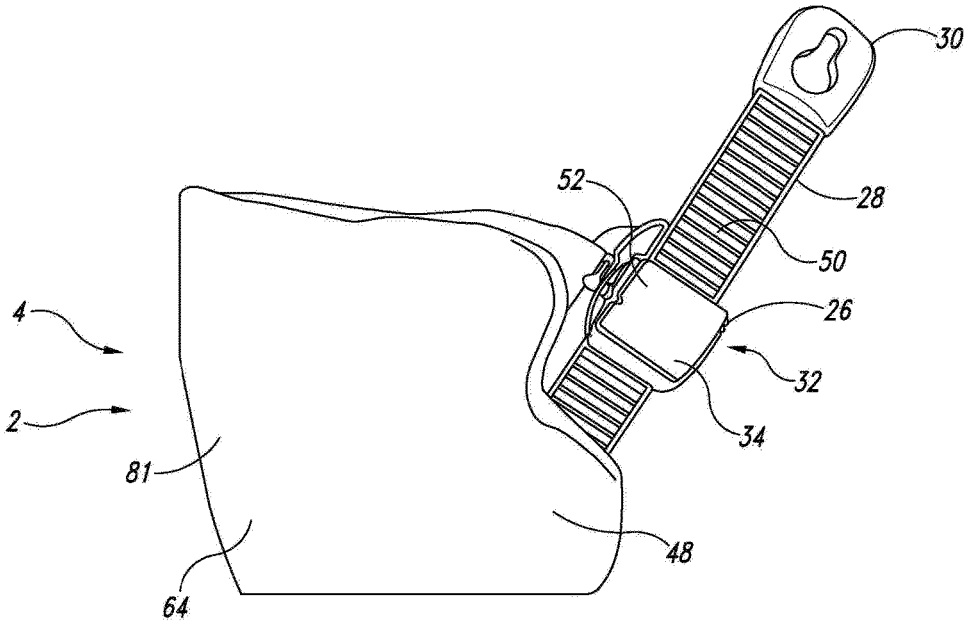
FIG. 2 depicts a side view of a crescent-shaped face protection element of an adjustable facial protection system as discussed herein.
Figure 3:
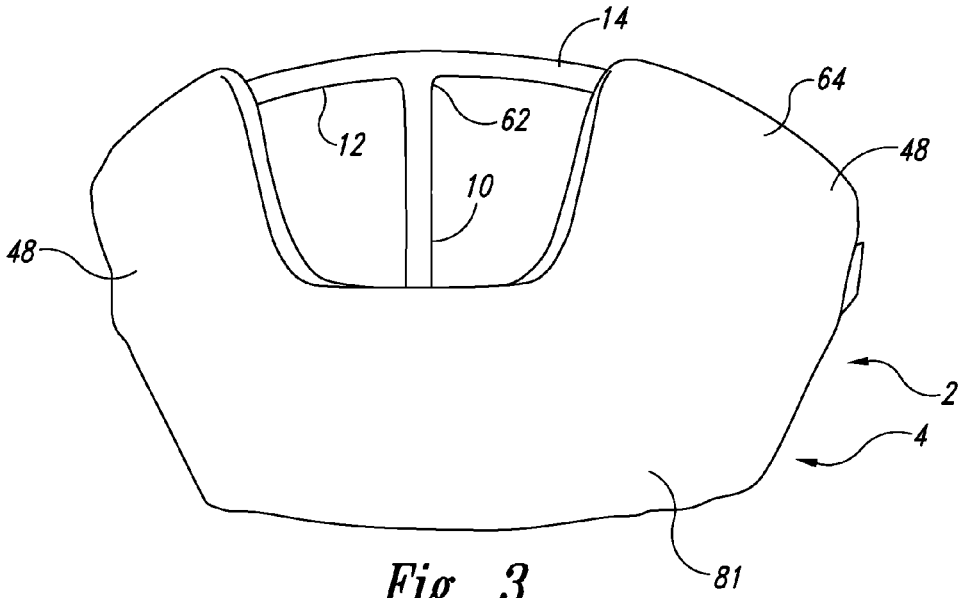
FIG. 3 depicts a front perspective view of a crescent-shaped face protection element of an adjustable facial protection system as discussed herein.
Figure 4:
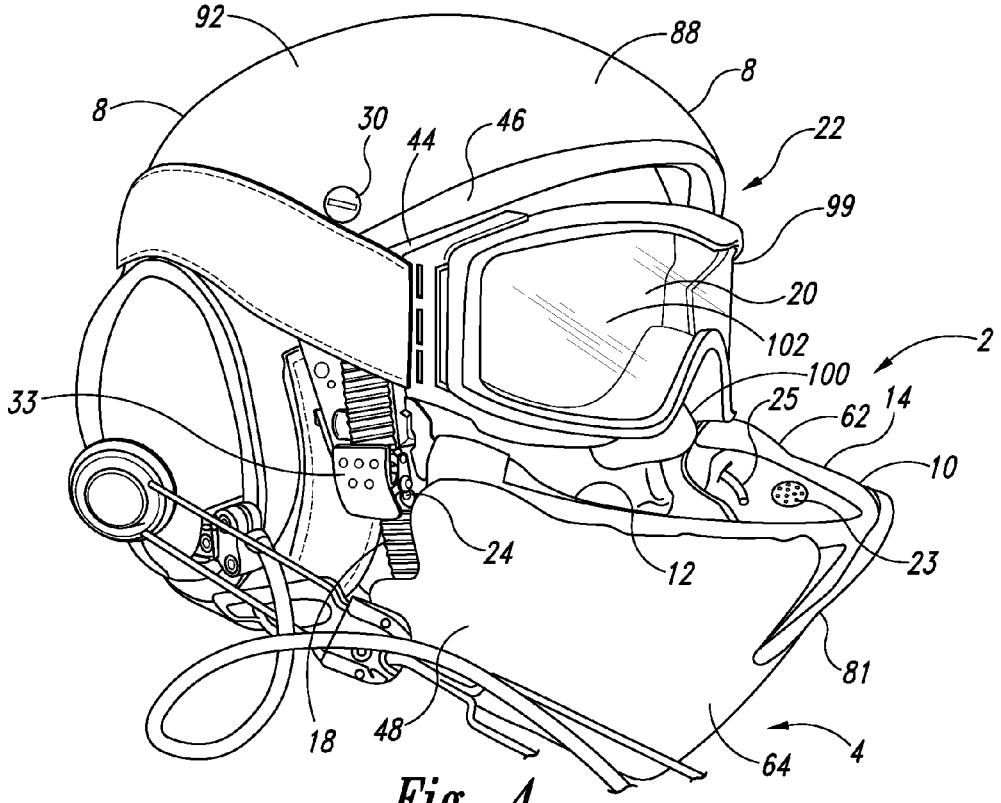
FIG. 4 depicts a side perspective view of an adjustable facial protection system in place on a Combat Vehicle Crewman (CVC) helmet as discussed herein.

Turning first to the exemplary embodiments shown in the Figures, FIGS. 1-3 depict a rear view, side view and front view, respectively, of a crescent-shaped face protection element 4 of an adjustable facial protection system 2 as discussed herein. Briefly, the crescent-shaped face protection element 4 is configured to withstand blunt force impact and at least one of ballistic or fragmentation projectiles and is configured to be attached to a protective helmet 8 as shown in FIGS. 4-11. Face protection element 4 comprises a substantially rigid frame 10 comprising a frame right side 12 and a frame left side 14. The face protection element 4 further comprises at least one interior contact point 16 configured to hold the face protection element 4 in place against a jaw 18 or face 20 of a user 22 as shown in FIG. 4. The frame right side 12 comprises at least one right side frame attachment element (24 in later FIGS.) and the frame left side 14 comprises at least one left side frame attachment element 26. The right side and left side frame attachment elements 24, 26 are attached to one or more corresponding pliable elongated connector elements 28 extending from the respective frame attachment elements on the protective helmet 8 such that the distance between the face protection element 4 and the helmet 8 can be selectively varied.

The elongated connector elements 28 are sufficiently pliable and resilient so as to securely retain the face protection element 4 on the jaw or face of a user 22 and in front of the user's face in all desired directions while simultaneously pliably suspending the face protection element 4 from the protective helmet 8. The elongated connector elements 28 can extend substantially vertically from the end areas 48 of either side of the face protection element 4. In FIG. 2, the elongated connector elements 28 comprise ratchet strip 50 and at least one of the frame attachment element or the helmet attachment element 30 comprises a ratchet mechanism 52 configured to releasably, selectively ratchet the elongated connector element.

The face protection element 4 in FIG. 1 comprises: a) an inner layer 56 comprising the interior contact points 16 which can be face pads 67. In this embodiment the face pads 67 comprise chin cup 70, a left cheek pad 68 and a right cheek pad 72, each comprised of an impact protection material 60. b) A substantially rigid frame layer 62 that comprises the substantially rigid frame 10, wherein the frame 10 is strong enough to resist a blunt force impact. And, c) a ballistic armor material layer 64, which comprises a material strong enough to resist both ballistic and fragmentation projectiles. The anti-ballistic layer 64 can be permanently or removably attached to at least one of the other two layers, for example via two anti-ballistic fabric attachment elements 80 configured to releasably retain the anti-ballistic layer 64 as the exterior 81 of the face protection element 4.

The inner layer 56 comprises a crush protection material 82, for example an energy dissipating foam 84 or an energy dissipating gel 86. The inner layer 56 can be discontinuous and the pads are held to each other and to the other layers of the face protection system 2 by at least one pad strap 74 or other coupling mechanism, which as shown extends from one side of the face protection system 2 to the other.

The attachment of the facial protection system 2 to the protective helmet 8 comprises one or more quick release mechanisms 32 such that at least one side of the face protection element 4 can be quickly released in a single motion by a user 22 from the protective helmet 8. The quick release mechanism 32 can be provided on both the right side and left side of the face protection element 4 to quickly release a part of or the entire face protection element 4 from the protective helmet 8, and the quick release mechanisms 32 can be a snap 34 as in FIG. 2, or a lever 33 as in FIG. 4.

The substantially rigid frame 10 can be ventilated with a plurality of ventilation holes 76 configured to pass substantial amounts of air from the exterior to the user 22. The ventilation holes 76 can comprise between about 20 percent to 30 percent of the surface area 78 of the substantially rigid frame 10 as in FIG. 1, or as much as 50 percent, 80 percent, 90 percent, 95 percent or more of the surface area 78 of the substantially rigid frame 10, as shown in other FIGS.

FIG. 4 depicts a side perspective view of an adjustable facial protection system 2 in place on a Combat Vehicle Crewman (CVC) helmet 92. In this Figure, helmet attachment elements 30 that connect to the pliable elongated connector elements 28 are located at about the temples 44 of a user 22 and on a forward lip 46 of forward portion 88 of the protective helmet 8. Goggles 99 lie above a nose 100 and protect the eyes 102 of user 22. FIG. 4 also demonstrates that the adjustable facial protection system 2 is sized and configured to cooperatively interact (or avoid, as appropriate) other items worn by a user such a headsets, microphones, electronics, etc. Further, the facial protection system 2 can also incorporate a headset, microphone, other electronics and other functional devices, etc., within the facial protection system 2 itself. For example, in the embodiment shown in FIG. 4, a microphone 23 and a water delivery tube 25 are incorporated into the facial protection system 2.

Figure 5:
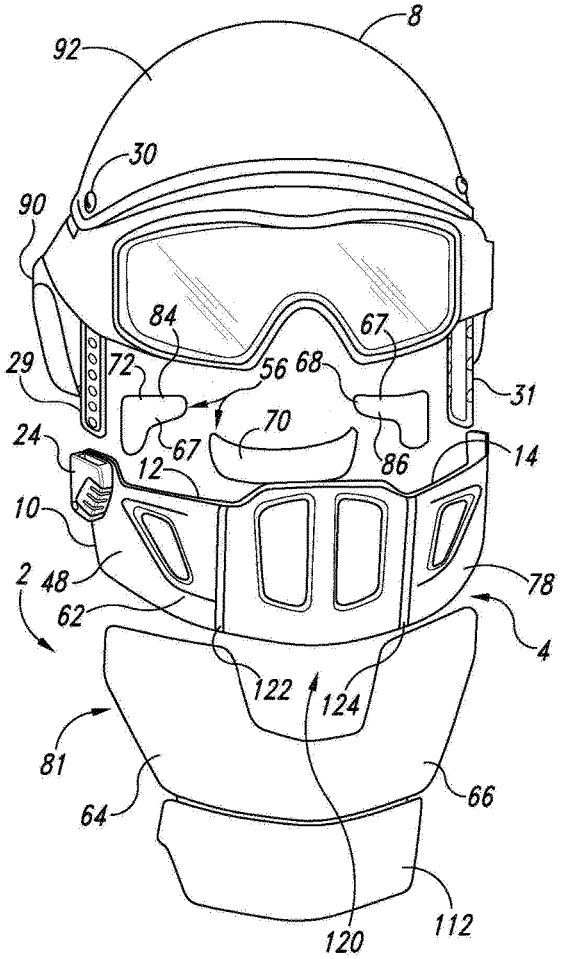
FIG. 5 depicts a front exploded view of an adjustable facial protection system as discussed herein showing exemplary face pads and chin cup on a Combat Vehicle Crewman (CVC) helmet.

FIG. 5 depicts a front exploded view of an adjustable facial protection system 2 showing exemplary face pads 67 including chin cup 58 with a Combat Vehicle Crewman (CVC) helmet 92 with unitary ear protection 90. The substantially rigid frame 10 comprises three frame pieces 120—as shown in FIG. 5, a first lateral frame piece, an intermediate frame piece, and a second lateral frame piece—joined at either side 122, 124 below the cheeks of a user, which allows the frame itself to be size adjustable to selectively increase or decrease the radius, breadth or width to better fit a wide variety of faces sizes and shapes. The ballistic armor material 64 of the face protection system 2 is also adjustable to selectively vary the radius, breadth or width of the ballistic armor material layer 64.

As with certain other embodiments herein ballistic armor material layer 64 comprises a material 66 strong enough to resist a variety of ballistic or fragmentation projectiles. Adjustable facial protection system 2 also comprises a neck protector 112, which is also made of a material 66 strong enough to resist a variety of ballistic and/or fragmentation projectiles. In this embodiment, neck protector 112 can move independently of the face protection element 4 and is sized to cover at least a substantial portion of a neck of a user 22. In addition, the right side quick release mechanism 32 comprises a pin and hole retention and release mechanism 29 while the left side quick release mechanism 32 comprises a detent retention and release mechanism 31.

Figure 6:
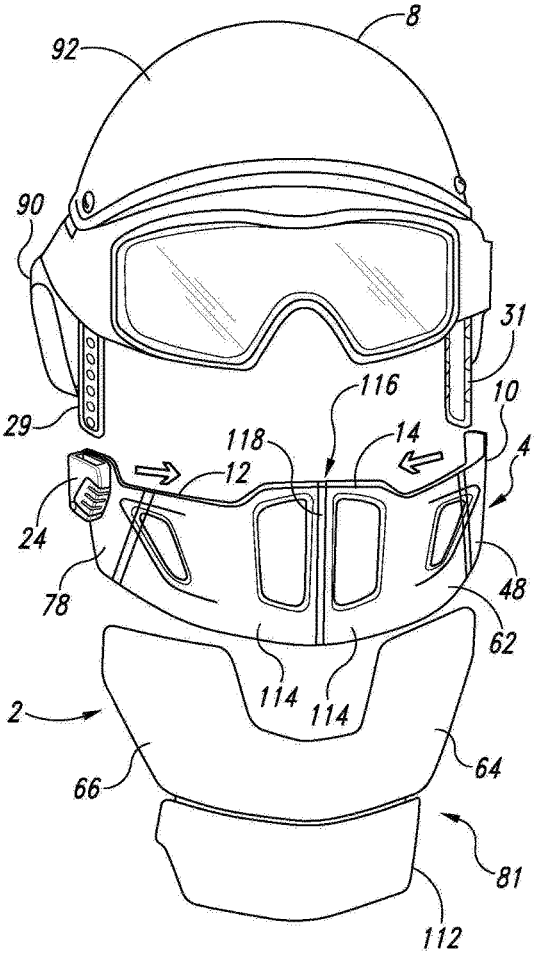
FIG. 6 depicts a front exploded view of an adjustable facial protection system as discussed herein a Combat Vehicle Crewman (CVC) helmet and comprising multiple pieces in the substantially rigid frame.

FIG. 6 depicts a front exploded view of an adjustable facial protection system 2 a Combat Vehicle Crewman (CVC) helmet 92 where the substantially rigid frame 10 comprises multiple frame pieces 114—as shown in FIG. 6, a first lateral frame piece and a second lateral frame piece. In the embodiment shown, two opposing frame pieces join in a center region 118 to provide an expandable joint 116 similar to the three-piece frame in FIG. 5 and likewise to provide adjustability in a lateral direction(s) to accommodate faces of different widths and shapes.

Figure 7:
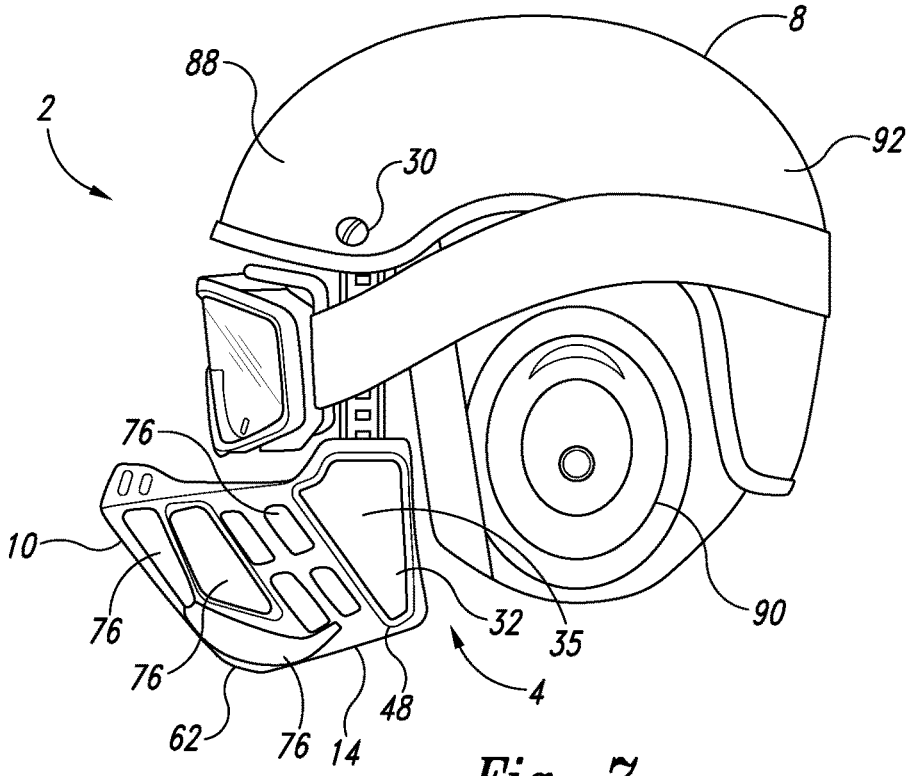
FIG. 7 depicts a side view of an adjustable facial protection system as discussed herein a Combat Vehicle Crewman (CVC) helmet.

FIG. 7 depicts another embodiment of an adjustable facial protection system 2 a Combat Vehicle Crewman (CVC) helmet 92, wherein the substantially rigid frame 10 comprises a different configuration for ventilation holes 76 and quick release mechanism 32 comprises a button retention and release mechanism 35.

Figure 8:
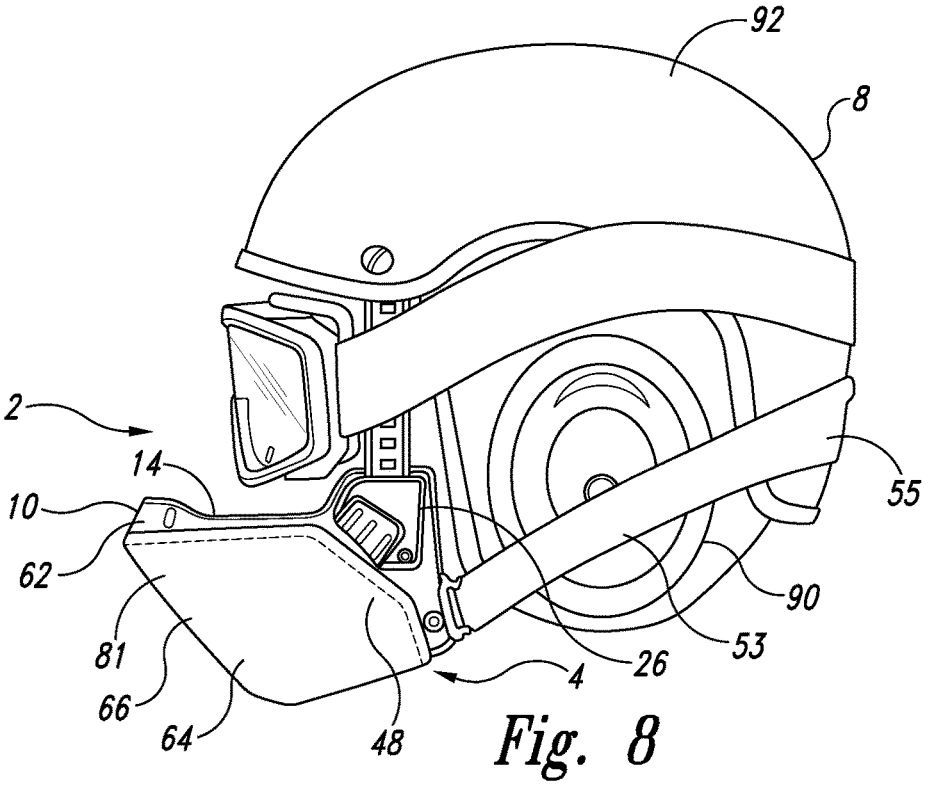
FIG. 8 depicts a side view of an adjustable facial protection system as discussed herein a Combat Vehicle Crewman (CVC) helmet including a tensioner member in the form of a helmet strap.

FIG. 8 depicts a side view of an adjustable facial protection system 2 a Combat Vehicle Crewman (CVC) helmet 92 including a tensioner member 53 as a helmet strap 55 extending from the face protection element 4 to helmet 8. The extensioner member can be any desired tensioner, such as a cloth strap, an elasticized strap, a spring, etc. and can connect at any desired location on the facial protection system 2, typically the face protection element 4, to any other suitable location such as the helmet 8, the neck of the user, etc.

Figure 9:
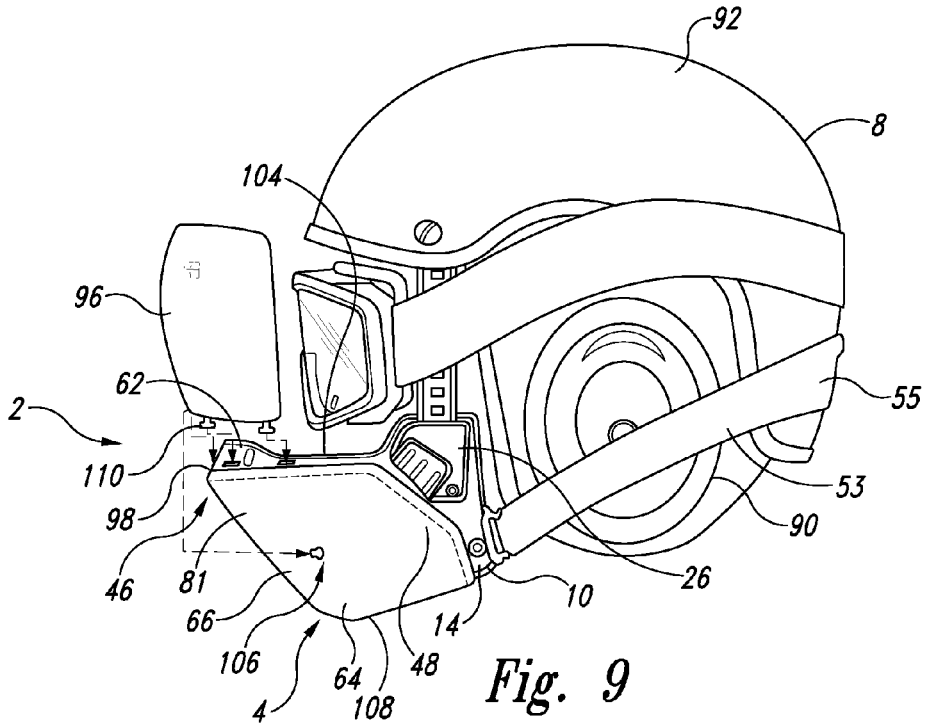
FIG. 9 depicts a side view of an adjustable facial protection system as discussed herein a Combat Vehicle Crewman (CVC) helmet including a transparent or optical face shield.

FIG. 9 depicts a side view of an adjustable facial protection system 2 a Combat Vehicle Crewman (CVC) helmet 92 including a transparent or optical face shield 96. The transparent or optical face shield 96 is sized and disposed to cover at least a nose and eyes of a user, and extends upwardly from the face protection element 4. The transparent or optical face shield 96 can, for example, extend from an upper edge 98 of the face protection element 4, from an uppermost edge 104 of the face protection element 4, or from a middle portion 106 between the upper edge 98 and a lower edge 108 of the face protection element 4. The transparent or optical face shield 96 is typically releasably attached to the face protection element 4, and can be spaced from the forward lip 46 of the protective helmet 8 by a fending standoff element 110 or other spacer as desired.

Figure 10:
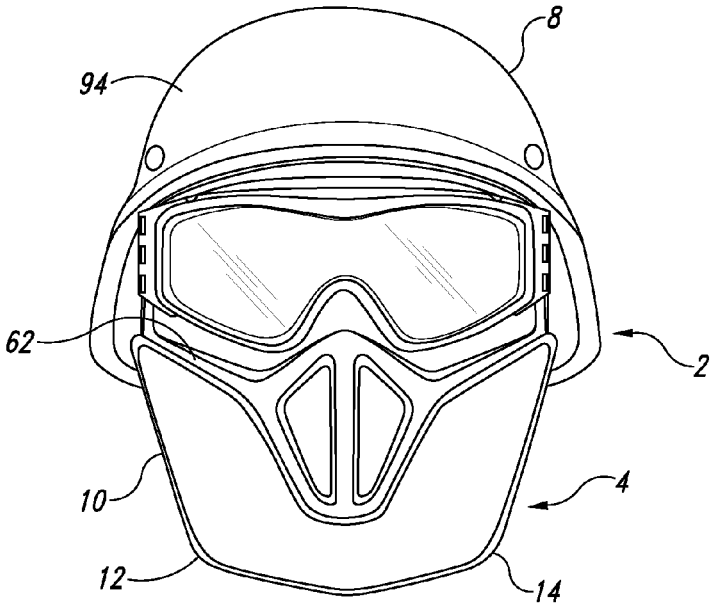
FIG. 10 depicts a front view of an adjustable facial protection system as discussed herein an Army Combat Helmet (ACH) helmet comprising an alternate configuration of the front air vent.

FIG. 10 depicts a front view of an adjustable facial protection system 2 an Army Combat Helmet (ACH) 94 that comprises an alternate configuration of the front air ventilation holes 76, where the bulk of the face protection element 4 is solid to provide increased protection from cold weather, projectiles, etc.

Figure 11A:
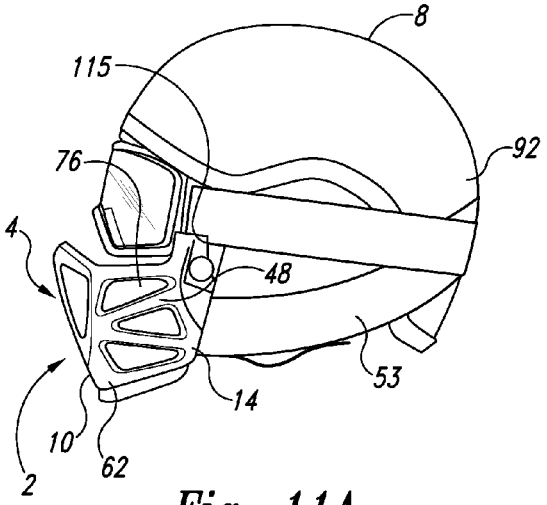
FIGS. 11A-D depict four side views of various embodiments of an adjustable facial protection system as discussed herein on a Combat Vehicle Crewman (CVC) helmet or an Army Combat Helmet (ACH) helmet depicting various embodiments of the protection system.
Figure 11B:
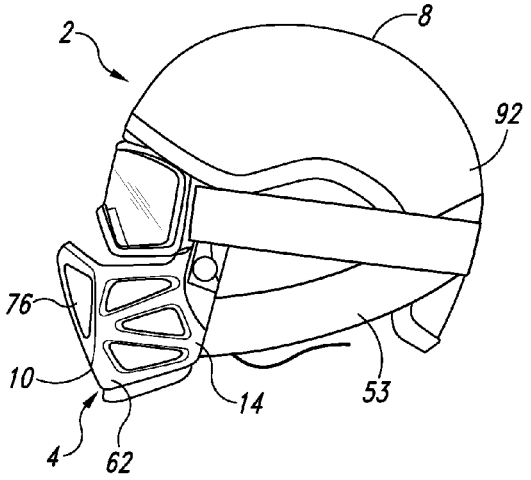
Figure 11C:
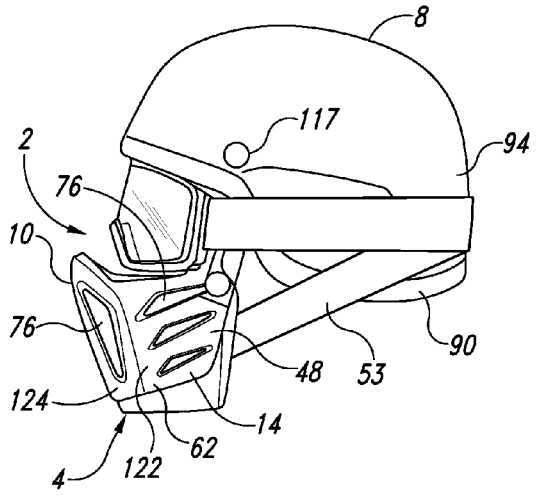
Figure 11D:
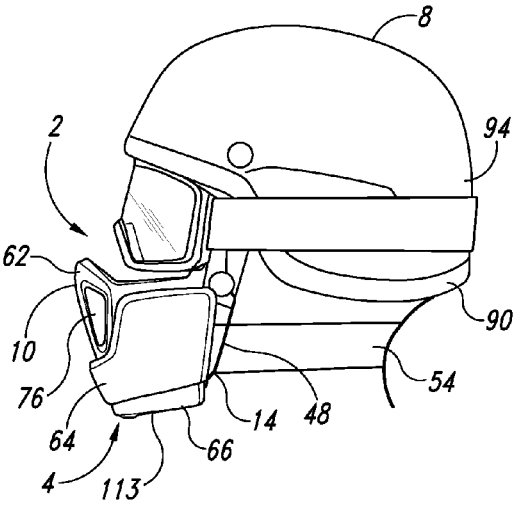

FIGS. 11A-D depict four side views of various further embodiments of an adjustable facial protection system 2 on a Combat Vehicle Crewman (CVC) helmet 92 (FIGS. 11A-B) or an Army Combat Helmet (ACH) helmet 94 (FIGS. 11C-D). The embodiments depict different configurations of the face protection element 4 including different ventilation holes 76. The embodiment in FIG. 11*a* further depicts a flange 115 that extends beyond the strap of goggles 99 and helps retain them in place. FIGS. 11A-B also show embodiments where the pliable elongated connector elements 28 extend upwardly from the face protection element 4 while FIGS. 11C-D show embodiments where the quick release mechanisms are helmet quick release mechanisms 117 located on ACH helmet 94. The embodiment in FIG. 11D further shows a throat protector 113 that is rigidly affixed to the face protection element 4 and a neck strap 54.

Figure 12:
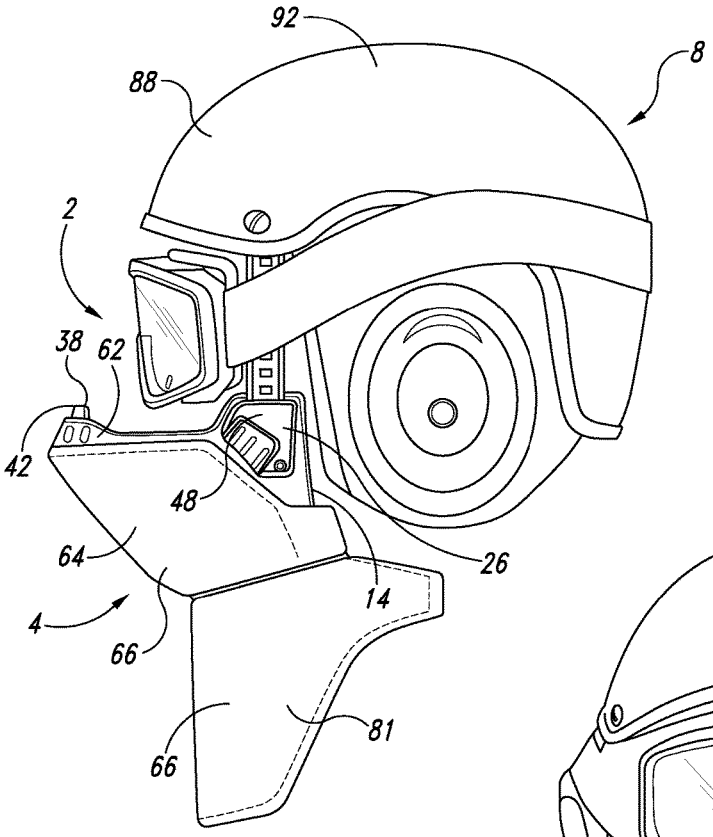
FIG. 12 depicts a side view of an adjustable facial protection system as discussed herein a Combat Vehicle Crewman (CVC) helmet and further comprising a neck or throat protector rigidly affixed to the face protection element and a single quick release activator.

FIG. 12 depicts a side view of an adjustable facial protection system 2 comprising a Combat Vehicle Crewman (CVC) helmet 92 and further comprises a neck protector 112 rigidly affixed to the face protection element 4. The system comprises opposed quick release mechanisms 32 and a single quick release activator 38 operably connected to the quick release mechanisms 32 such that activation of the activator simultaneously releases all quick release mechanisms in a single motion. In the embodiment in FIG. 12, the single quick release activator 38 is a twistable knob 42.

Figure 13:
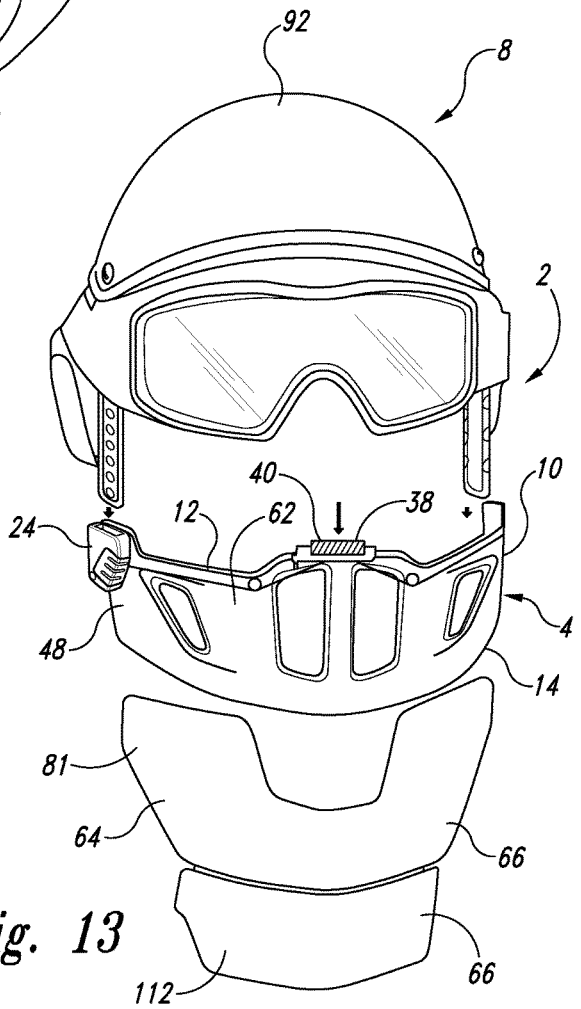
FIG. 13 depicts a front view of an adjustable facial protection system as discussed herein a Combat Vehicle Crewman (CVC) helmet and further comprising a neck or throat protector that can move independently of the face protection element and a single quick release activator.

FIG. 13 depicts a front view of an adjustable facial protection system 2 comprising a Combat Vehicle Crewman (CVC) helmet 92 and further comprises a neck protector 112 that can move independently of the face protection element 4. Similar to FIG. 12, the system in FIG. 13 comprises opposed quick release mechanisms 32 and a single quick release activator 38 where the single quick release activator 38 is a depressible button 40.

Figure 14:
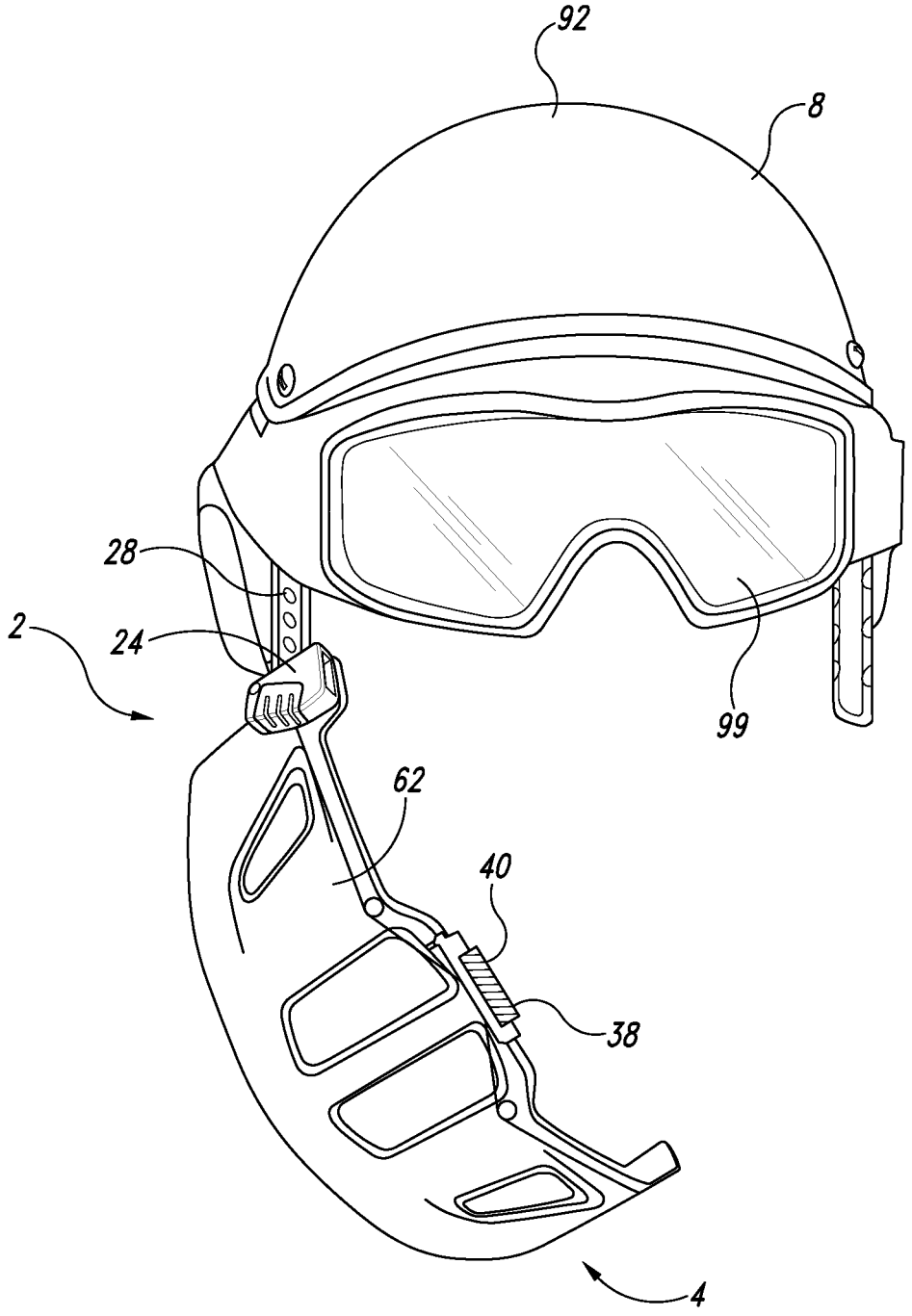
FIG. 14 depicts a front view of an adjustable facial protection system as discussed herein a Combat Vehicle Crewman (CVC) helmet wherein the face protection element has been released on one side by a single quick release activator and thus dangles from the other side of the helmet.

FIG. 14 depicts a front view of an adjustable facial protection system 2 as discussed herein a Combat Vehicle Crewman (CVC) helmet 92 wherein the face protection element 4 has been released on one side by a single quick release mechanism 32 and thus dangles from the other side of the helmet 8.

Turning to a further general discussion of the present systems and methods, such provide, in certain aspects, a two-point, adjustable, partially pliable, and releasable tensioning suspension that supports an anti-blunt-force frame connected to a protective helmet. The frame is positioned and balanced on the wearer's face by an impact absorbing face padding system, including a cupped chin pad. This design allows the device to be worn more closely to a wide variety of face sizes which is advantageous in confined spaces such as inside military vehicles. It also has the benefit of being rapidly removable from the wearer's face in the event that a gas mask must be donned suddenly, or if the wearer's facial area needs medical attention. The close proximity to the face in some embodiments also increases the wearer's field of view and allows for eye protection such as goggles to be easily donned and doffed. Optional applications of the design could include open frame designs at the mouth area to allow heat and exhaled moisture to dissipate to the outside environment without impedance. The present systems and methods comprise methods and compositions.

Thus, one of the basic purposes of the systems is to provide: a) ballistic and fragmentation protection and b) blunt force trauma protection in a single device/system/face mask.

As one part of this, the systems, etc., herein comprise a flexible suspension system that is semi-independent of the helmet and thus allowing movement of the facial protection system somewhat independent of the helmet. This flexible suspension system can be provided by the elongated connector elements discussed herein. The flexible suspension system, and/or other elements of facial protection systems herein, can also permit size adjustment of face mask relative to size of head. The facial protection systems can also provide a single detachment activator (e.g., button) that releases both sides/entire face mask (facial protection element) instantly and simultaneously, e.g., to allow access to helmet to attach alternate device such as a gas mask, or to allow access to the face by a medic. In addition, if desired only one of the elongated connector elements can be released so it snaps on/off, so that the face mask can be easily released from the face in the event that a lower threat level is encountered, but still kept in immediate proximity to the face in the event that an increased threat level—especially a sudden, surprising increased threat level such as an ambush—is presented.

The systems typically comprise a 2 point suspension from the helmet to the face mask, and can comprise a neck strap around the back of neck or a side/rear helmet strap. The neck strap, etc., can comprise a quick release to allow mask to be lifted or pivoted forward and up.

The face mask comprises a rigid frame layer, which can provide a "skeleton" maintaining the form and structure of the face mask, which frame may be fully continuous, discontinuous and/or ventilated. The face mask also comprises a ballistic armor material such as soft armor (aramids and others) or hard armor (ceramics and others). This combination provides ballistic and/or fragmentation protection with blunt force protection via impact load distribution over a larger area. Either the ballistic protection element or the rigid frame can be on the outside of the overall face mask.

In some embodiments, the face mask comprises three layers: a) inner layer against face comprising a chin strap, pad and/or cup and an impact absorbing foam or gel, b) an exoskeleton comprising the rigid frame layer (which can be semi-rigid or fully rigid and can have holes in it for ventilation but can be a solid "sheet" structure if desired), and c) an outer layer comprising a ballistic armor material layer. B) and c) can be reversed in order if desired. In some embodiments, the ballistic armor material can be removable from the skeleton; i.e., the face mask can also be layers a) and b) only, but in such instance the layers typically have an option to include layer c), e.g., attachment points for such structure.

In some embodiments, an energy dissipating foam or gel (or similar; i.e., a protective crush-material) is used in the jaw (e.g., maxilla and/or mandible) and face regions, similar to the use of such materials in crash helmets.

The face mask can have the ability to easily remove ballistic fabric layer to create a fully vented blunt force protector only, and the face mask can have an easily adjustable degree of frag protection with varying thickness or coverage of the ballistic armor material. Similarly, the face mask can have varying degrees of coverage/thickness of the rigid, skeleton layer, and can have adjustable and removable degrees of blunt force protection via removable facial and chin pads.

In certain embodiments, a single facial protection system can be size-adjusted to fit on any desired helmet, such as both the Combat Vehicle Crewman (CVC) and Army Combat Helmet (ACH). Thus, a single device can be configured for use with a variety of helmets including helmets with ear coverage/protection and helmets without ear coverage/protection (e.g., to provide open space about a user's ears for headphones, ear muffs, etc.).

It can also be possible to release only one side of the facial protection element for quick "swing away" of the mask, allowing quick don and doff. This release can release the entire system below one or both of the elongated connector element(s), or can be of the ballistic fabric layer only, which can assist ventilation while keeping at least some of the overall protection in place.

The devices, systems, etc., herein can, if desired, be integrated into, worn alongside, and/or replace existing helmet suspension systems, e.g., existing chin straps, etc.

The devices, systems, etc., herein can, if desired, integrate a protective lens or transparent or optical face shield thus combining facial protection with eye protection. This can be in addition to or instead of goggles or other eyewear worn by the user. Generally, the lens/face shield extends upward from the forward edge area of the jaw protector of the face mask, in front of goggles (if worn) and the eyes of the user. The upper edge of the optical face shield can be maintained a significant distance such as up to 2 inches or more from the front lip of the helmet, and thus not attach to the helmet, so that ventilation is better. Alternatively, the optical face shield element can abut the front lip of the helmet, for example using a fending standoff element.

The devices, systems, etc., herein can, if desired, comprise interchangeable facial pads as a means of fit and positioning.

The devices, systems, etc., herein can, if desired, comprise an accessory drape for additional neck protection, with or without independent movement of drape relative to the face mask or other elements of the system. The drape typically extends downwardly from the bottom of the front edge of the ballistic material. Typically, the drape can comprise anti-blunt force and/or anti-ballistic properties.

The facial protection systems can, if desired, be configured such that the rigid, skeletal structure has one or more splits or other structures in the middle area, or even in the precise center, to provide enhanced adjustability and thus comfort and range of use. For example, the "split" can comprise a soft, elastic material to provide some protection over the open area, or can be a center region hinge. There can also be other adjustment configurations, such as dual (or more) width adjustment elements located on either side of the face protector.

The ballistic armor material layer such as a ballistic fabric can also be expandable/retractable for sizing. Similarly to the rigid layer, the ballistic armor material layer could comprise a single, or dual (or more) width adjustment elements located on the front or either side of the face protector. In one embodiment, the ballistic armor material layer width adjustment elements can be under a protective rigid layer piece to provide reduced risk of injury.

The facial protection systems can, if desired, comprising a fairly substantial chin cup, typically padded, to help keep the system in place on the face of a user.

The present application is further directed to methods of making the various elements of the systems and apparatus herein, including making the systems and apparatus themselves from such elements, as well as to methods of using the same, including for example applying the facial protection systems to a user's face and/or head, manipulating the various elements of the facial protection systems, and removing partially or completely the facial protection systems from the user's face and/or head, or otherwise as desired.

All terms used herein are used in accordance with their ordinary meanings unless the context or definition clearly indicates otherwise. Also unless expressly indicated otherwise, the use of "or" includes "and" and vice-versa. Non-limiting terms are not to be construed as limiting unless expressly stated, or the context clearly indicates, otherwise (for example, "including," "having," and "comprising" typically indicate "including without limitation"). Singular forms, including in the claims, such as "a," "an," and "the" include the plural reference unless expressly stated, or the context clearly indicates, otherwise.

The scope of the present devices, systems and methods, etc., includes both means plus function and step plus function concepts. However, the claims are not to be interpreted as indicating a "means plus function" relationship unless the word "means" is specifically recited in a claim, and are to be interpreted as indicating a "means plus function" relationship where the word "means" is specifically recited in a claim. Similarly, the claims are not to be interpreted as indicating a "step plus function" relationship unless the word "step" is specifically recited in a claim, and are to be interpreted as indicating a "step plus function" relationship where the word "step" is specifically recited in a claim.

From the foregoing, it will be appreciated that, although specific embodiments have been discussed herein for purposes of illustration, various modifications may be made without deviating from the spirit and scope of the discussion herein. Accordingly, the systems and methods, etc., include such modifications as well as all permutations and combinations of the subject matter set forth herein and are not limited except as by the appended claims or other claim having adequate support in the discussion and FIGS. herein.

What is claimed is:

1. An adjustable facial protection system configured to be attached to a protective helmet having first and second helmet attachment elements, the adjustable facial protection system comprising, a first connector element configured to be attached to the first helmet attachment element;

a second connector element configured to be attached to the second helmet attachment element;

a face protection element configured to be held in place against a jaw or face of a user, the face protection element comprising a substantially rigid frame configured to resist blunt force impact, the face protection element comprising:

a first side having a first frame attachment element with a first quick release mechanism, the first frame attachment element being configured to removably attach to the first connector element via the first quick release mechanism and being configured to allow the distance between the first side of the face protection element and the helmet to be selectively varied;

a second side having a second frame attachment element with a second quick release mechanism, the second frame attachment element being configured to removably attach to the second connector element via the second quick release mechanism and being configured to allow the distance between the second side of the face protection element and the helmet to be selectively varied; and a quick release activator affixed on a surface of the substantially rigid frame, the quick release activator being operably connected to both the first and second quick release mechanisms, the quick release activator configured to removably detach both the first and second quick release mechanisms from the first and second connector elements when actuated, wherein the connector elements are configured to suspend the face protection element from the protective helmet.

2. The face protection system of claim 1 wherein the first and second connector elements are configured to extend substantially vertically between the first and second helmet attachment elements when the user's head is in an upright position and corresponding first and second frame attachment elements when the face protection element is connected to the protective helmet, the connector elements configured to provide a flexible suspension system.

3. The face protection system of claim 1 wherein the first frame attachment element is positioned proximate a first lateral side of the face protection element and the second frame attachment element is positioned proximate a second lateral side of the face protection element which is laterally opposite the first lateral side.

4. The face protection system of claim 1 wherein at least one of the first and second quick release mechanisms is a snap.

5. The face protection system of claim 1 wherein at least one of the first and second quick release mechanisms comprises a pin and hole retention and release mechanism.

6. The face protection system of claim 1 wherein the activator is a depressible button.

7. The face protection system of claim 1 wherein the activator is a twistable knob.

8. The face protection system of claim 1 wherein the connector elements are configured to extend substantially vertically from end areas of either side of the face protection element when the user's head is in an upright position.

9. The face protection system of claim 1 wherein the connector elements are configured to extend substantially vertically from the protective helmet to end areas of either side of the face protection element when the user's head is in an upright position.

10. The face protection system of claim 1 wherein the connector elements comprise ratchet strips configured to be ratcheted by ratchet mechanisms, wherein at least one of the first and the second frame attachment elements or the first and second helmet attachment elements comprises the ratchet mechanisms configured to ratchet the connector elements.

11. The face protection system of claim 1 wherein the face protection system further comprises at least one tensioner member for stabilizing the face protection system on the user.

12. The face protection system of claim 1 wherein the face protection element comprises:

an inner layer configured to contact the jaw or face of the user, the inner layer comprising at least one chin cup comprising an impact protection material;

a substantially rigid frame layer comprising the substantially rigid frame, wherein the substantially rigid frame is configured to resist a blunt force impact; and a ballistic armor material layer comprising a material configured to resist both ballistic and fragmentation projectiles.

13. The face protection system of claim 12 wherein the three layers are arranged as follows from an interior of the face protection element to an exterior of the face protection element: the inner layer then the substantially rigid frame layer then the ballistic armor material layer.

14. The face protection system of claim 13 wherein the ballistic armor material layer is removably attached to at least one of the other two layers.

15. The face protection system of claim 12 wherein the inner layer comprises at least:

a left cheek pad configured to be attached to a left side of the substantially rigid frame, a right cheek pad configured to be attached to a right side of the substantially rigid frame, and a chin strap, cup or pad configured to be attached to a middle portion of the substantially rigid frame.

16. The face protection system of claim 15 wherein the inner layer is discontinuous and the pads are held to each other and to the other layers of the face protection system by at least one pad strap extending from one side of the face protection system to the other side of the face protection system.

17. The face protection system of claim 12 wherein the substantially rigid frame is rigid.

18. The face protection system of claim 12 wherein the substantially rigid frame is ventilated with a plurality of ventilation holes configured to allow air to pass therethrough to the user.

19. The face protection system of claim 18 wherein the ventilation holes comprise between 20 percent to 30 percent of the surface area of the substantially rigid frame.

20. The face protection system of claim 18 wherein the ventilation holes extend over at least 50 percent of the surface of the substantially rigid frame.

21. The face protection system of claim 18 wherein the ventilation holes extend over at least 80 percent of the surface of the substantially rigid frame.

22. The face protection system of claim 1 wherein the face protection element comprises:

an inner layer comprising at least one chin cup comprising an impact protection material; and a substantially rigid frame layer comprising the substantially rigid frame, wherein the substantially rigid frame is configured to resist a blunt force impact, wherein at least one of the inner layer and the substantially rigid frame layer comprises at least two anti-ballistic fabric attachment elements configured to releasably retain an anti-ballistic layer as an exterior of the face protection element.

23. The face protection system of claim 22 wherein the inner layer comprises a crush protection material selected from at least one of an energy dissipating foam and an energy dissipating gel.

24. The face protection system of claim 1 wherein, upon release of one side of the face protection element from one of the first and second helmet attachment elements, the face protection element is configured to swing freely and hang downwardly via the connector element from the other of the first and second helmet attachment element along a forward portion of the protective helmet.

25. The face protection system of claim 1 wherein the face protection system is sized and configured to be used with a variety of protective helmets including at least a protective helmet with ear coverage protection and a protective helmet without ear coverage protection.

26. The face protection system of claim 1 wherein the face protection system is sized and configured to be used with a Combat Vehicle Crewman (CVC) helmet.

27. The face protection system of claim 1 wherein the face protection element further comprises an optical face shield extending upwardly from an upper edge of the face protection element and sized to cover at least a nose and eyes of the user.

28. The face protection system of claim 27 wherein the optical face shield is releasably attached to the upper edge of the face protection element.

29. The face protection system of claim 27 wherein the optical face shield is attached to an uppermost edge of the face protection element.

30. The face protection system of claim 27 wherein the optical face shield is attached to at least a middle portion between the upper edge and a lower edge of the face protection element.

31. The face protection system of claim 27 wherein the optical face shield is tinted gray, yellow, brown or rose.

32. The face protection system of claim 27 wherein the optical face shield comprises a UV protective lens material.

33. The face protection system of claim 27 wherein an upper edge of the optical face shield is spaced from the forward lip of the protective helmet when the face protection element is fully attached to the protective helmet.

34. The face protection system of claim 27 wherein an upper edge of the optical face shield is configured to be spaced from a forward lip of the protective helmet by a fending standoff element.

35. The face protection system of claim 1 wherein the face protection system further comprises at least one neck or throat protector extending downwardly from the face protection element and sized to cover at least a substantial portion of a neck of the user.

36. The face protection system of claim 35 wherein the neck or throat protector is rigidly affixed to the face protection element.

37. The face protection system of claim 35 wherein the neck or throat protector is attached such that the neck or throat protector can move independently of the face protection element.

38. The face protection system of claim 1 wherein the substantially rigid frame is configured to be size adjustable to selectively increase or decrease the breadth or width of the substantially rigid frame.

39. The face protection system of claim 1 wherein the substantially rigid frame comprises:

a first lateral frame piece to which the first frame attachment element is coupled, the first lateral frame piece configured to extend at least across a portion of a first side of the user's face when worn by the user to shield the portion of the first side of the user's face;

a second lateral frame piece to which the second frame attachment element is coupled, the first lateral frame piece configured to extend at least across a portion of a second side of the user's face when worn by the user to shield the portion of the second side of the user's face;

wherein the first and second lateral frame pieces are configured to be joined together.

40. The face protection system of claim 39 wherein the substantially rigid frame comprises an intermediate frame piece configured to extend at least across a portion of a front side of the user's face when worn by the user to shield the portion of the front side of the user's face, wherein the first and second lateral frame pieces and the intermediate frame piece are configured to be joined together with the intermediate frame piece positioned between the first and second lateral frame pieces.

41. The face protection system of claim 40 wherein a ballistic armor material of the face protection system is also adjustable to selectively vary the breadth or width of the ballistic armor material.

42. The face protection system of claim 1, further comprising a helmet.

43. The face protection system of claim 42 wherein, when worn by the user, the first and second helmet attachment elements are configured to be located at about the temples of the user and on a forward lip of the protective helmet.

44. The face protection system of claim 1, wherein the face protection system is configured for sports-level activities.

45. The face protection system of claim 1, wherein the face protection system is configured for military or law enforcement level activities.

46. An adjustable facial protection system configured to be attached to a protective helmet via one or more connector elements, the adjustable facial protection system comprising:

a face protection element configured to be held in place against a jaw or face of a user, the face protection element comprising a modular frame configured to resist blunt force impact, the modular frame comprising:

a first lateral frame piece forming a first side of the modular frame, the first lateral frame piece configured to extend at least across a portion of a first side of the user's face when worn by the user to shield the portion of the first side of the user's face;

a second lateral frame piece forming a second side of the modular frame, the second lateral frame piece configured to extend at least across a portion of a second side of the user's face when worn by the user to shield the portion of the second side of the user's face; and an intermediate frame piece configured to extend at least across a portion of a front side of the user's face when worn by the user to shield the portion of the front side of the user's face;

wherein the first and second lateral frame pieces and the intermediate frame piece are configured to be joined together with the intermediate frame piece positioned between the first and second lateral frame pieces;

a first frame attachment element coupled to the first lateral frame piece, the first frame attachment element being configured to removably attach to one of the one or more connector elements and being configured to allow the distance between the first lateral frame piece and the helmet to be selectively varied; and a second frame attachment element coupled to the second lateral frame piece, the second frame attachment element being configured to removably attach to one of the one or more connector elements and being configured to allow the distance between the second lateral frame piece and the helmet to be selectively varied;

wherein the face protection element is configured to be securely retained on the jaw of the user and in front of the user's face when worn by the user.

* * * * *